United States Patent [19]

Bonazoli et al.

[11] 4,113,420

[45] Sep. 12, 1978

[54] FLASHLAMP ASSEMBLY WITH TAPERED HOUSING

[75] Inventors: Robert P. Bonazoli, Hamilton; William H. Morgan, Jr., Assonet, both of Mass.

[73] Assignee: GTE Sylvania Incorporated, Stamford, Conn.

[21] Appl. No.: 812,916

[22] Filed: Jul. 5, 1977

[51] Int. Cl.[2] ..... F21K 5/02

[52] U.S. Cl. ..... 431/93; 362/3

[58] Field of Search ..... 431/93, 92; 362/3, 16

[56] References Cited

U.S. PATENT DOCUMENTS

| | | | |
|---|---|---|---|
| 3,535,063 | 10/1970 | Anderson et al. | 431/93 |
| 3,597,604 | 8/1971 | Shaffer | 431/92 |
| 3,692,996 | 9/1972 | Shaffer et al. | 431/93 |

*Primary Examiner*—Carroll B. Dority, Jr.
*Attorney, Agent, or Firm*—Robert P. Bonazoli

[57] ABSTRACT

A disposable, manually operable flashlamp assembly which uses a percussively-ignitable flashlamp. The assembly includes a housing with a tapered end and a tubular light-transmitting end in which is positioned the flashlamp's envelope. The tapered end cocks a spring during insertion of the housing within an orificed base member after which the spring aligns with a recess in the housing. The spring enters the recess to strike a portion of the flashlamp's projecting primer tube, causing the flashlamp to fire.

10 Claims, 3 Drawing Figures

FLASHLAMP ASSEMBLY WITH TAPERED HOUSING

CROSS REFERENCE TO COPENDING APPLICATIONS

In a copending application listed under Ser. No. 796,795 entitled "Copy Apparatus Using Chemical Flashlamp" (Inventor: T. Fohl), there is described a portable copy system designed for use with photosensitive papers. Ser. No. 796,795 was filed May 13, 1977 and is assigned to the assignee of the present application.

In an application listed under Ser. No. 812,833 filed July 5, 1977 and entitled "Light Exposure Device Including Light Diffusing and Absorbing Regions Therein" (Inventors: R. E. Levin and G. J. English), there is described an expandable portable light exposure device.

The flashlamp assembly of the present application is capable of being used within the apparatus defined in the above copending applications.

An application under Ser. No. 813,109 was also filed July 5, 1977, entitled "Percussive Flashlamp Assembly" (R. P. Bonazoli et al). Ser. No. 813,109 is a design application for a flashlamp assembly using a single percussively-ignitable flashlamp.

All of the above applications are assigned to the assignee of the present invention.

BACKGROUND OF THE INVENTION

The invention relates to flashlamp assemblies and particularly to flashlamp assemblies which use percussively-ignitable flashlamps. Even more particularly, the invention relates to flashlamp assemblies of the nature described which are disposable.

Flashlamp assemblies which use percussively ignitable flashlamps are well known in the art. One example is defined in U.S. Pat. No. 3,597,604 (J. W. Shaffer), said patent assigned to the assignee of the present invention. The assembly as described therein is used primarily for photographic purposes and is readily adapted for being positioned on a suitable camera. The camera actuates each lamp in conjunction with the shutter operation, said actuation being accomplished by engagement and release of the striker spring associated with each lamp. The spring strikes the flashlamp's projecting primer tube with sufficient force to cause deformation thereof. As a result, the fulminating material in the tube deflagrates upwardly to ignite the combustible material (e.g. shredded zirconium) within the lamp's glass envelope. An example of a percussively-ignitable flashlamp suitable for use in the aforementioned flashlamp assembly is defined in U.S. Pat. No. 3,535,063 (L. F. Anderson et al), which is also assigned to the assignee of the instant invention.

The flashlamp assembly of the present invention is of much simpler construction than the assembly of U.S. Pat. No. 3,597,604 and therefore easier to actuate and less expensive to produce. The invention utilizes a single percussively-ignitable flashlamp which is fired only when the assembly is inserted within a common firing mechanism. The assembly, being disposable, is thereafter removed and discarded. Another assembly may then be inserted within the mechanism and fired. This relatively simple procedure makes the present invention ideally suited for use in singular, low-cost flash operations such as desired in the apparatus of the above copending applications. The invention is also safe to operate and readily permits manual insertion and firing thereof.

It is believed therefore that a flashlamp assembly possessing the above several advantageous features would constitute an advancement in the art.

OBJECTS AND SUMMARY OF THE INVENTION

It is therefore an object of the present invention to provide a flashlamp assembly which is inexpensive to produce, operates in a relatively simple manner, and may be discarded after use.

It is a further object to provide as flashlamp assembly wherein the assembly's actuating mechanism may be reusable with other flashlamps once the original lamp has been fired, removed, and discarded.

In accordance with one aspect of the invention, there is provided a flashlamp assembly which comprises an elongated housing having a light-transmitting first end and a tapered second end. A recess is located between these ends with a portion of the primer tube of the assembly's percussively-ignitable flashlamp located therein. The flashlamp's envelope is positioned within a chamber defined by the tubular first end.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
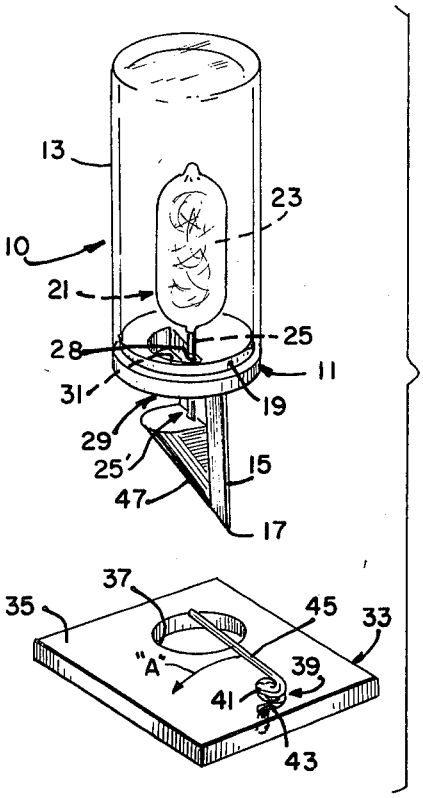
FIG. 1 is an exploded isometric of a flashlamp assembly in accordance with one embodiment of the invention.

With particular reference to FIG. 1, there is shown a flashlamp assembly 10 in accordance with one embodiment of the invention. Assembly 10 comprises an elongated housing 11 which includes a light-transmitting first end portion 13 and a tapered second end porton 15 adjacent thereto. Tapered end 15 is positioned such that the tip portion 17 points away from the remainder of housing 11. End 13 is tubular and preferably of cylindrical configuration and is securedly positioned (e.g. cemented) on a corresponding cylindrically-shaped seating portion 19 of tapered end 15.

Assembly 10 further comprises a percussively-ignitable flashlamp 21 which includes a light-transmitting envelope 23 and a primer tube 25 projecting therefrom. An example of a percussively-ignitable flashlamp suitable for use in the present invention is described in the aforementioned U.S. Pat. No. 3,535,063, the disclosure of which is incorporated herein by reference. Flashlamp 21 is positioned such that envelope 23 is located within an elongated chamber 27 (FIG. 2) defined by the tubular end 13. Primer tube 25 projects downwardly and lies within a groove 28 formed within end 15 such that a portion, 25', of the tube is located within a recess 29 formed between ends 13 and 15.

Seating portion 19 includes at least one opening 31 therein which has access to chamber 27 to permit escape or venting of any gases or heat build-up within the chamber as a result of the firing of lamp 21. Opening 31 opens into recess 29.

In the embodiment of FIG. 1, assembly 10 further comprises means 33 for actuating flashlamp 21 when the tapered end 15 of housing 11 is positioned therein. Means 33 comprises a base 35 having an orifice 37 therein which receives tapered end 15. Adjacent orifice 37 is a striking means 39 which preferably comprises a helical torsion striker spring 41 having a first end 43 anchored within base 35 and a second end or striking arm 45 extending across orifice 37. Should assembly 10 be used in either of the apparatus defined in the aforementioned copending applications, the respective housing of these apparatus could serve as the base 35 with orifice 37 provided therein.

Manual firing of flashlamp 21 is readily accomplished by the operator holding the tubular housing 13 and inserting tapered end 15 into orifice 37. The angular surface 47 of tapered end 15 slidably engages strikng arm 45 to thus cock (or prestress) the arm during insertion (in a direction "A" in FIG. 1). Continued insertion results in additional displacement of arm 45 until the arm aligns with recess 29. Arm 45 will then enter the recess and strike primer tube 25 with sufficient force to deform the tube and cause firing of lamp 21. As explained in Pat. No. 3,535,063, deformation of the primer tube causes the fulminating material therein to ignite and deflagrate up through the tube to ignite the combustible material within the envelope. The result is a flash of relatively high output (e.g. 5,000 to about 12,000 lumen seconds) with a peak intensity occuring within the range of about 5 to about 15 milliseconds after initiation.

Figure 2:
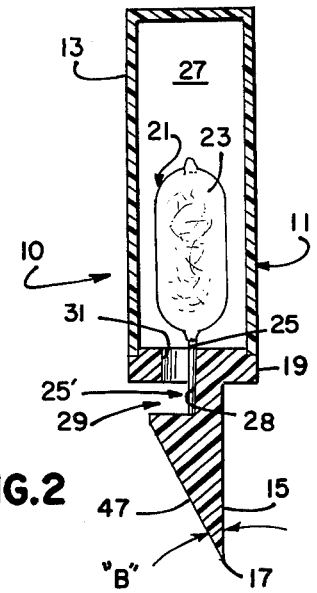
FIG. 2 is a side elevational view, in section, of the flashlamp assembly of FIG. 1.
Figure 3:
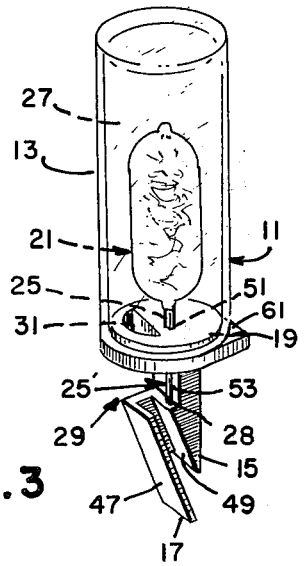
FIG. 3 is an isometric view of a flashlamp assembly according to another embodiment of the invention.

In the embodiment of FIGS. 1 and 2, it is necessary to rotate housing 11 at least 90° in either direction after firing to effect release of tapered end 15 from means 33. In FIG. 3, there is shown an alternate embodiment for tapered end 15 whereby a longitudinal slot 49 is located therein. Slot 49 is substantially parallel to the engaging surface 47 and has access to recess 29, thereby providing means whereby assembly 10 may be directly removed from orifice 37 without the need for the aforedescribed rotation. This is possible because striking arm 45 of spring 41 aligns with slot 49 after striking primer tube 25. The arm will simply slide within slot 49 during upward removal of the assembly.

In the embodiment of FIG. 3, it is preferred to change the location of opening 31 from that shown in FIG. 1. Opening 31 in FIG. 3 still interconnects chamber 27 with recess 29 but is spaced from primer tube 25 as indicated. As a result, an annular hole 51 is provided in seating portion 19 to accommodate primer tube 25. This arrangement strengthens the positioning location of the assembly's primer tube over that of FIG. 1 wherein tube 25 was located in the elongated groove 28. In FIG. 3, groove 28 only runs the length of the wall 53 adjacent recess 29.

The angle of taper ("B" in FIG. 2) is the same for both of the embodiments of FIGS. 1 and 3 and is preferably within the range of about 15 to 30 degrees. In one example of the invention, housing 11 is 2.25 inches long with tubular end 13 being about 1.75 inches in length. Ends 13 and 15 and base 35 are preferably plastic (e.g. acryllic and styrene) while spring 41 is steel (e.g. music wire). The materials for flashlamp 21 are well known in the art.

Thus there has been shown and described a flashlamp assembly which is easy to fire, inexpensive to produce, and readily adaptable for manual operation. While there have been shown the preferred embodiments of the invention, various modifications are possible. For example, base 35 could include an upstanding, light-transmitting portion which would substantially surround end 13 when end 15 is inserted within orifice 37. Such an upstanding portion could include an opening therein of a specific (e.g. D-shaped) cross-sectional configuration such that only an end 13 of substantially similar configuration could be inserted therein. If a D-shaped accommodating opening were employed, seating portion 19 would also be D-shaped and thus include an extending flat side 61 (FIG. 3) to assure positive alignment between housing 11 and said upstanding portion.

Other alignment means could also be employed to assure positive alignment of tapered end 15 with orifice 37 and thus eliminate the need for rotation of housing 11 after lamp firing. As an example, end 15 could be keyed with a corresponding slot provided in orifice 37.

While there have been shown and described what are at present considered the preferred embodiments of the invention, it will be obvious to those skilled in the art that various changes and modifications may be made therein without departing from the scope of the invention as defined by the appended claims.

What is claimed is:

1. A flashlamp assembly comprising:

an elongated housing including a light-transmitting first end portion defining a chamber therein, a second end portion adjacent said first end portion, said second end portion including a tapered end portion and a recess between said tapered end portion and said first end portion; and a percussively-ignitable flashlamp having a light-transmitting envelope and a primer tube projecting therefrom, said envelope positioned within said chamber within said first end portion and said primer tube securedly positioned within said second end portion such that a portion of said primer tube is located within said recess.

2. The flashlamp assembly according to claim 1 wherein said second end portion includes at least one opening therein, said opening having access to said chamber within said first end portion.

3. The flashlamp assembly according to claim 2 wherein said second end portion includes a substantially cylindrical seating portion joined to said first end portion, said seating portion including said opening therein.

4. The flashlamp assembly according to claim 3 wherein said first end portion of said housing is substantially cylindrical.

5. The flashlamp assembly according to claim 1 wherein said second end portion includes a longitudinal slot therein, said longitudinal slot having access to said recess.

6. The flashlamp assembly according to claim 1 further including actuating means for actuating said percussively-ignitable flashlamp.

7. The flashlamp assembly according to claim 6 wherein said actuating means comprises a base having an orifice therein for receiving said tapered second end portion of said housing and striking means for striking said primer tube of said percussively-ignitable flashlamp when said tapered second end portion is positioned within said orifice.

8. The flashlamp assembly according to claim 7 wherein said striking means comprises a striker spring positioned within said base adjacent said orifice and including an extended striking arm, said striking arm engaging said tapered second end portion during positioning of said second end portion within said orifice and thereafter entering said recess within said housing to strike said portion of said primer tube located therein.

9. The flashlamp assembly according to claim 8 wherein said tapered second end portion of said housing prestresses said striking arm of said striker spring prior to said arm striking said primer tube.

10. The flashlamp assembly according to claim 8 wherein said tapered second end portion includes a longitudinal slot therein having access to said recess, said extended striking arm of said striker spring moving within said longitudinal slot during removal of said tapered second end portion from said orifice.

* * * * *